United States Patent [19]

McGathey

[11] 3,931,810

[45] Jan. 13, 1976

[54] ROTARY-PISTON INTERNAL COMBUSTION ENGINE

[76] Inventor: Wendell H. McGathey, 374 George St., P.O. Box 745, Fredericton, New Brunswick, Canada

[22] Filed: Sept. 27, 1973

[21] Appl. No.: 401,457

[30] Foreign Application Priority Data

July 6, 1973 Canada ..... 175899

[52] U.S. Cl. ..... 123/44 E

[51] Int. Cl.[2] ..... F02B 57/00

[58] Field of Search ..... 123/44 E, 43 C, 44 C

[56] References Cited

UNITED STATES PATENTS

| | | | |
|---|---|---|---|
| 879,512 | 2/1908 | Braunwalder | 123/44 E |
| 1,646,695 | 10/1927 | Hubbard | 123/44 E |
| 1,827,094 | 10/1931 | McCann | 123/44 E |
| 1,853,563 | 4/1932 | Hungerford et al. | 123/44 E |
| 1,990,660 | 2/1935 | McCann | 123/44 E |
| 2,036,060 | 3/1936 | Lewis | 123/44 E |
| 2,129,960 | 9/1938 | Presby | 418/266 |
| 2,217,796 | 10/1940 | Dell | 123/44 E |

FOREIGN PATENTS OR APPLICATIONS

| | | | |
|---|---|---|---|
| 782,174 | 5/1935 | France | 123/43 C |

*Primary Examiner*—C. J. Husar
*Assistant Examiner*—O. T. Sessions
*Attorney, Agent, or Firm*—Browdy and Neimark

[57] ABSTRACT

A rotary-piston internal combustion engine having one or any number of rotary pistons, mounted in a cylindrical cylinder block, the cylinder block being mounted for rotation in an elliptical casing, on a central hub associated with said casing. A central drive shaft is connected to the cylinder block for rotation therewith, and each cylinder provides one power stroke per revolution of the cylinder block. Each cylinder is provided with a push rod, adapted to be restrained against the interior of the cylindrical wall of the engine casing. The engine is self-lubricating, and eliminates the need for a crankshaft, has a minimum of moving parts and thus friction points are minimal provides a hugh power-to-weight ratio and minimizes exhaust emissions. Ignition may be either by spark means, or by dieseling.

6 Claims, 12 Drawing Figures

ROTARY-PISTON INTERNAL COMBUSTION ENGINE

The art relating to internal combustion engines is going through a phase of rapid transition, with a great deal of emphasis and public attention being directed to the rotary engine, as opposed to the well established reciprocating piston engine.

The internal combustion engine which will be described and claimed herein has been created with a view to taking advantage of the best features of traditional piston engines, and the newer rotary engines, while eliminating the disadvantages of both.

As will become evident in the light of the following disclosure, the rotary-piston internal combustion engine which has now been invented makes available a high horsepower-to-weight ratio, as well as high horsepower-to-revolutions per minute ratio; is extremely compact, and has an absolute minimum of moving parts and friction points.

Further, the subject engine may be of either two or four cycles, and lends itself to a multitude of applications. All moving parts are self-lubricated in both the two and our cycle versions by an oil reservoir located in the lower portion of the assembly housing.

Cooling can be accomplished and controlled by liquid coolants, oil, air, or any combination thereof.

The subject engine has been designed to provide one or more power strokes to every revolution of the cylinder block, and hence the power take-off shaft. Thus, as the number of pistons is increased in the cylinder block the number of power strokes per revolution will increase proportionately. The engine is designed so that it may be mounted either vertically or horizontally, and in any event with a power take-off shaft available on both sides of the installation. The design of this engine eliminates the need for a crankshaft, valves, cam shafts, wrist pins, gears, eccentric shafts, connecting rods and so on.

Equally important, the engine hereof has been designed to facilitate emission controls, inasmuch as all of the functions of the engine occur within an enclosed sealed compartment, excepting only the necessary breather vents.

Another primary concern in designing the engine has been to facilitate manufacture, including assembly; as well, maintenance is simplified inasmuch as there are a minimum of moving parts, and disassembly is relatively simple, in order to gain access to all such moving parts.

A high torque ratio is also provided by the engine, and thus an excellent horsepower ratio per unit of fuel is also achieved.

The engine is further designed so that one or a plurality of spark plugs may be provided in the single combustion chamber area. Further, this engine may be operated as a diesel.

Moreover, the engine herewith permits ready multiple in-line installation, as may be required in certain commercial applications.

A wide tolerance of ignition timing is also permitted, and fuel and air may be fed to the cylinder cavity of this engine, by way of suction, atmospheric pressure, supercharger, fuel injection, or the like, as is well known in the art.

Moreover, the need for an oil pump for lubricating is eliminated, but if desired, an oil pump may be embodied for the purpose of forcing oil through an oil-filtering apparatus.

Another important feature of the engine is that manufacturing with a single exterior housing assembly may be modified to accommodate a cylinder block having any desired number of cylinders. In other words, a common exterior housing assembly may be used for engines according to the invention having one or any desired number of pistons that the cylinder block will conveniently accommodate. Further, the physical characteristics of the engine housing lend themselves to various reinforcing and mounting structures, to greatly facilitate subsequent installation of the engine in the locale for which it is destined.

A still further object is to provide a rotary-piston internal combustion engine comprising: an elliptical engine casing having a central, cylindrical hub; a circular cylinder block centrally mounted within said casing for rotation therein and around said hub, and having at least one radial cylinder adapted to receive a piston for reciprocation therein; said piston having an associated push rod projecting therefrom radially toward said casing, said push rod terminating in a bearing adapted to be restrained against the inner wall of said casing; igniting means provided in said hub in radial alignment at or near the shortest radius of said elliptical casing; a fuel intake port and an exhaust port provided in said hub opposite said igniting means; and central drive shaft means within said hub on which said cylinder block is mounted, for rotation therewith.

The engine will now be described with reference to the accompanying drawings in which.

Detailed reference will now be made to the drawings, wherein like reference numerals will identify like parts.

Figure 1:
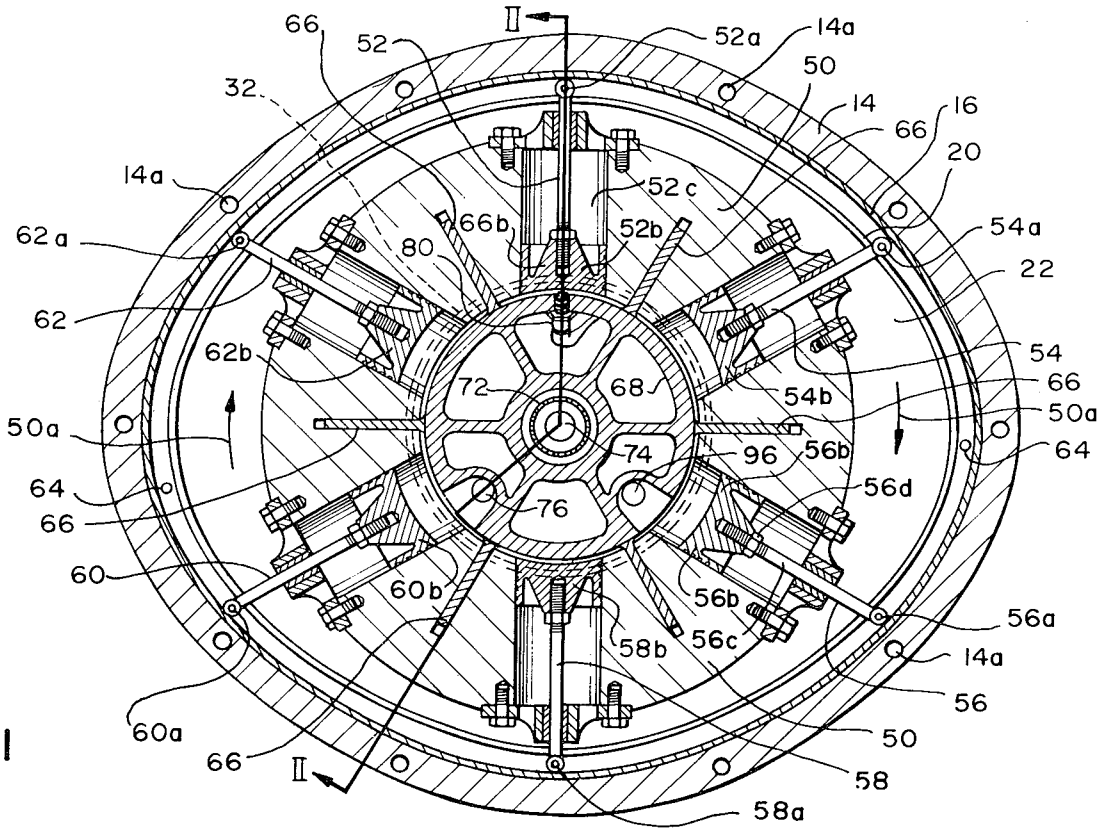
FIG. 1 is a central sectional view through the engine casing and piston assembly.

Referring now in detail to the drawings, in FIG. 1 an elliptical housing 14 contains a cylindrical cylinder block 50, adapted for rotation therein in the direction of arrow 50*a*. Cylinder block 50 includes a plurality of cylinders, in this instance six, in which are mounted for reciprocal movement a plurality of pistons, 52, 54, 56, 58, 60 and 62, respectively, each having a piston push rod which terminates in a bearing, indicated at 52*a*, 54*a*, 56*a*, 58*a*, 60*a* and 62*a*, respectively. Each of the piston push rod bearings is contained within a piston push rod track 64, which will be described in more detail hereinafter. Mounted within cylinder block 50, between each cylinder, is a sealing vane 66, each of which is spring urged toward a cylindrical hub 68 of the engine casing 14. Drive shaft 74 is located at the center of hub 68, and rides on a suitable bearing assembly 72.

Referring to piston 56*b* of FIG. 1, it will be seen that push rod 56 is threadably engaged within piston 56*b*, and is restrained therein by lock nut 56*d*. It will be appreciated therefore that the compression ratio of piston 56*b* may be simply adjusted by effectively extending or decreasing the length of push rod 56 by screwing into or out of piston 56*b*.

As is well known in internal combustion piston engines, suitable piston rings are employed.

Figure 2:
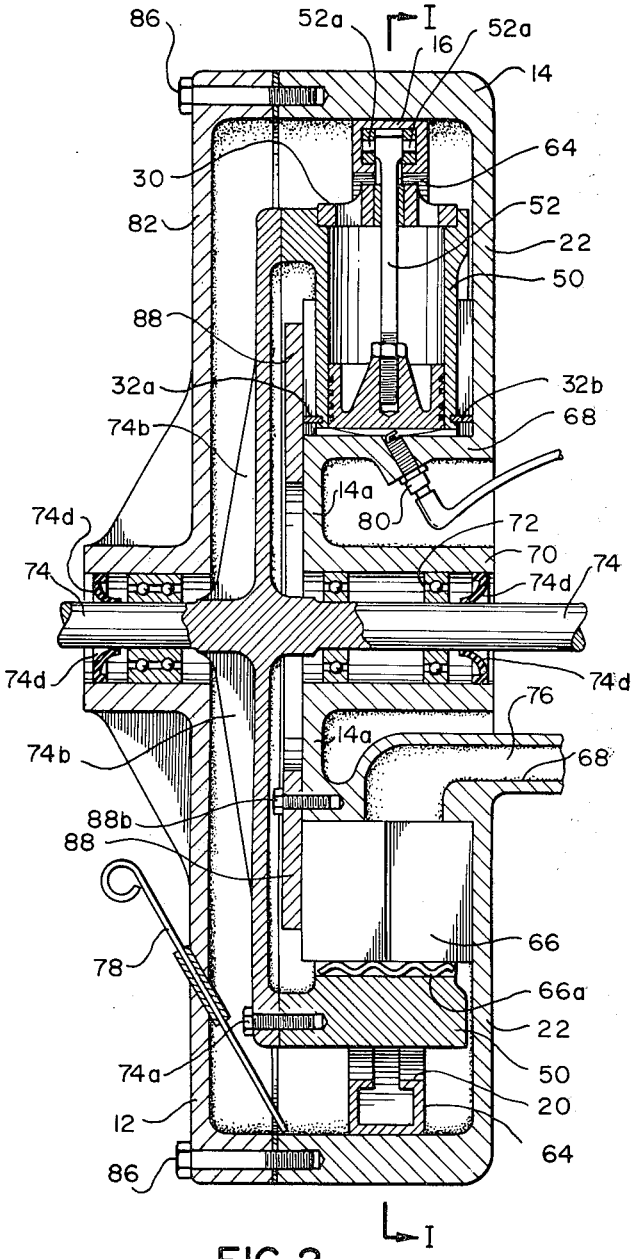
FIG. 2 is a sectional view taken along 2—2 of FIG. 1.

Referring now to FIG. 2, piston 52 and its associated push rod, terminating in bearing 52*a* is clearly illustrated, bearing 52*a* being contained within piston push rod track and bearing 64. It will be seen that the piston push rod bearing comprises a pair of bearings 52*a*, which are illustrated in the form of rollers axially mounted at the end of the piston rod remote from the piston head, which rollers are contained within piston push rod track 64. Thus it will be appreciated that each piston push rod and its associated piston is restrained from relative movement away from the elliptical wall 14 of the engine casing while cylinder block 50 is rotated under power. Track 64 will be described in more detail hereinafter in connection with FIG. 9. Referring momentarily to both FIGS. 1 and 2, a fuel intake port is indicated at 76. Sealing vane 66 is adjacent one side of fuel intake port 76, and it will be seen that vane 66 is spring urged toward inner hub 68, by means of corrugated spring 66*a* (see FIG. 2), contained within cylinder block 50, (or by means of a coil spring — see FIG. 7). Also illustrated in FIG. 2 is an oil level drip stick 78 and spark plug 80. Spark plug 80 is also illustrated in FIG. 1, but it should be mentioned that the engine herein is adaptable to function as a diesel, and thus spark plug 80 is not an essential component.

One or more pairs of sealing rings 32 are mounted in the wall of cylinder block 50, sealing rings 32 serving to eliminate any escape of combustion gases, and to eliminate loss of compression. Only one such pair is illustrated in FIG. 2. Sealing rings 32 are spring urged against engine casing wall 22, and extend between sealing vanes 66. It is believed that this structure will become evident in the light of the following description of sealing vanes 66. Suitable spring means are provided within cylinder block 50, and spring means such as illustrated in FIGS. 6 and 7 may be employed, although it will be evident that other suitable spring arrangements will be apparent to those skilled in the art.

Figure 3:
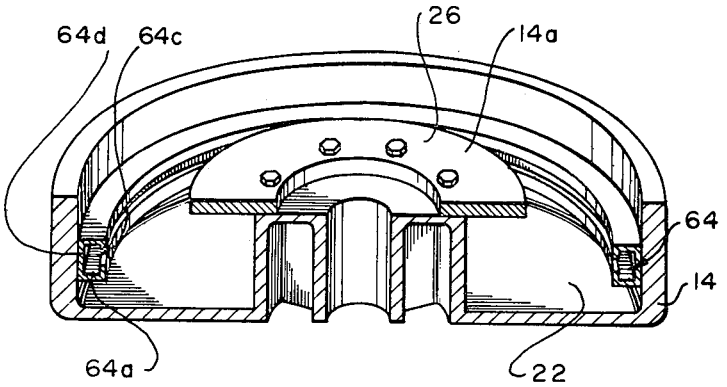
FIG. 3 is a fragmentary perspective view of an engine casing according to the invention.
Figure 9:
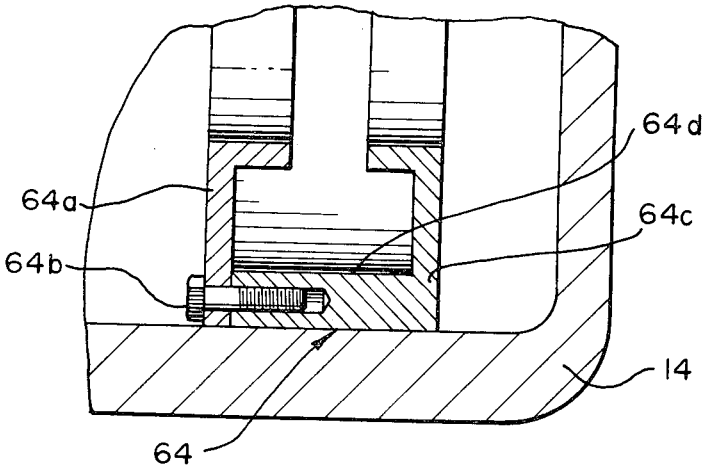
FIG. 9 is an enlarged sectional view of a push rod bearing restraining track.

Referring now to FIG. 3, push rod track 64 is illustrated more clearly. Track 64 comprises two walls, 64*a* and 64*c*, each having an inwardly extending lip, which together form a track to receive push rod bearings 52, and track 64 is suitable affixed to the inner side of engine casing 14. Walls 64*a* and 64*c* have an outer bearing surface 64*d*. The track assembly is most conveniently constructed of two segments which may be united by bolting or the like, in order to facilitate insertion of push rod bearings 52*a*. As seen in FIG. 9 such push rod restraining track 64 comprises an L-shaped portion 64*a* affixed by a plurality of bolts, one of which is illustrated at 64*b*, to a cooperating track portion 64*c*, to create the desired T-shaped restraining track, having bearing surface 64*d* on which the push rod bearings will ride, and in which such bearings will be restrained.

Figure 4:
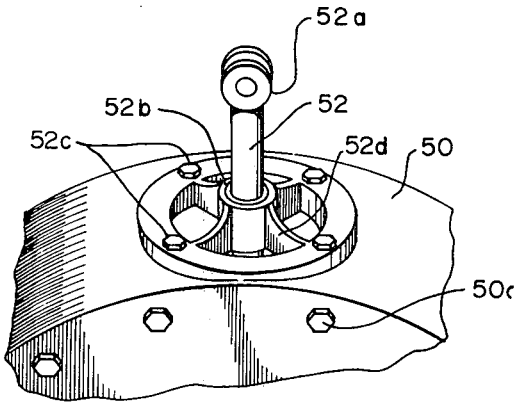
FIG. 4 is a fragmentary perspective view of a cylinder block according to the invention, and of a piston push rod projecting therethrough.

With reference to FIG. 4, push rod 52, and its associated bearing 52*a* are seen projecting through a suitable bearing 52*b* mounted by bolts 52*c* to the exterior of cylinder block 50. Bearing 52 is provided with suitable venting openings 52*d*, to facilitate reciprocation of the piston associated with push rod 52, as well as to facilitate lubrication of the piston within the cylinder as will be evident to those skilled in the art.

Figure 5:
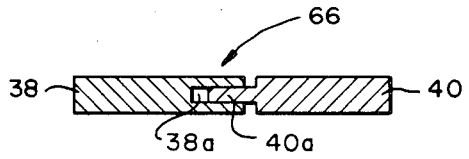
FIG. 5 is a top plan view of a sealing vane.
Figure 6:
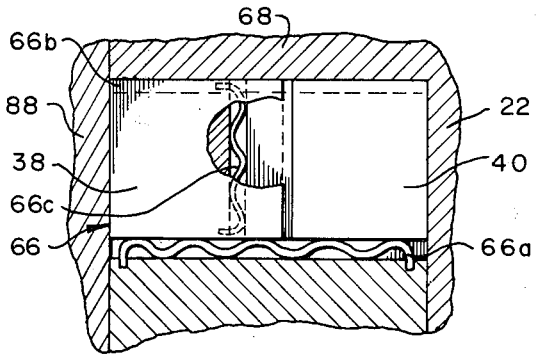
FIG. 6 is a side plan view of the sealing vane according to FIG. 5.
Figure 7:
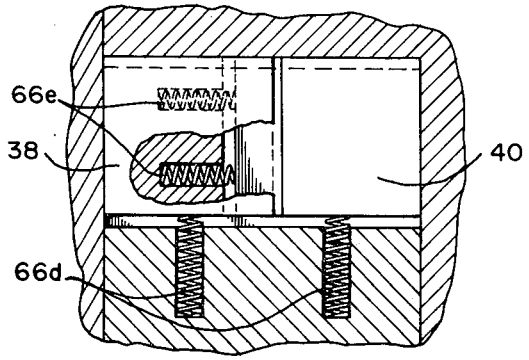
FIG. 7 is a side plan view of an alternative structure for the sealing vane of FIG. 6.

FIGS. 5 and 6 illustrate a sealing vane 66, and in FIG. 5 vane 66 is shown in transverse section, and is seen to comprise a pair of cooperating sections 38 and 40, interlocked by means of tongue 40*a* on section 40, which projects into groove 38*a* in section 38. A corrugated spring 66*c* which is visible in FIG. 6 urges sections 38 and 40 apart, to ensure sealing engagement with elliptical wall 22 of engine casing 14, and retainer ring 88 which is bolted to the opposite side of the engine housing by means of bolts 88*b* (as illustrated in FIG. 2). The bearing edge 66*b* of sealing vane 66 is urged by corrugated spring 66*a* toward the interior circular hub 68 of engine casing 14.

FIG. 7 illustrates an alternative sealing vane arrangement utilizing coil springs 66d and 66e, as an alternative to corrugated springs 66*a* and 66*c*, respectively.

Referring back to FIG. 2, cylinder block seal and sealing vane retainer ring 88 is mounted by means of bolts 88b to wall 14*a* of hub 68, and thus, retainer ring 88 remains stationary, and serves as a bearing surface, for vanes 66 as well as for sealing ring 32*a*. Similarly sealing ring 32*b* is urged against wall 22 of casing 14.

Figure 8:
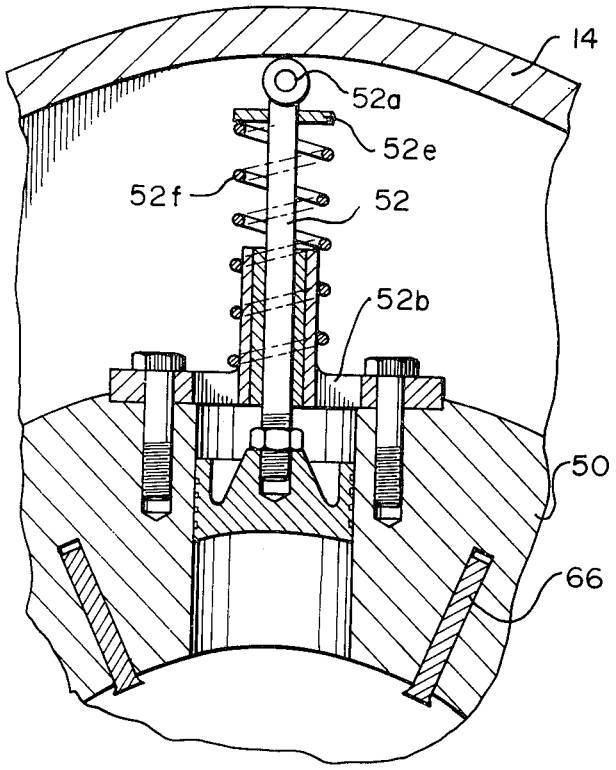
FIG. 8 is a sectional view of an alternative push rod bearing assembly and structure, on an enlarged scale.

An alternative push rod restraining mechanism is illustrated in FIG. 8. Push rod 52 of FIG. 8 is provided with a bearing, 52a, as already described with reference to FIG. 4. A stop member 52*e* is fixed to push rod 52, and a coil spring 52*f* abuts stop 52*e* at its outer end, and push rod bearing assembly 52*b* at its opposite end. Thus, push rod 52 is normally urged against engine casing 14, which is provided with a suitable bearing surface on which push rod bearing 52*a* will travel.

Figure 10:
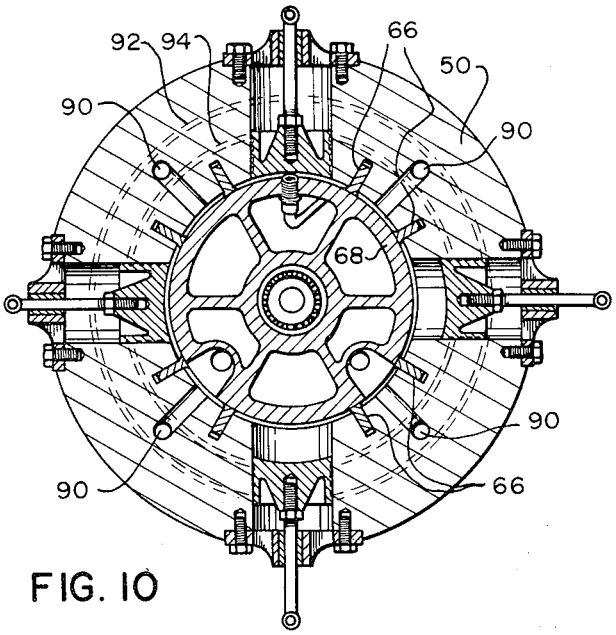
FIG. 10 is a central sectional view of a cylinder block and piston assembly, of a four-cylinder engine according to the invention.

Referring now to FIG. 10, a four-cylinder cylinder block and piston assembly is illustrated, and it will be seen that cylinder block 50 is of substantially the same structure as illustrated in FIG. 1. Similarly, the piston and push rod assemblies are identical, aside from the fact that only four are present.

Between each pair of cylinders, a pair of sealing vanes 66 are provided, sealing vanes 66 being structurally identical to the sealing vanes already described above. In a four cylinder embodiment it will be appreciated that there is a relatively greater distance between cylinders, and that there is therefore a longer circumferential space between the interior of cylinder block 50 and hub 68 between adjacent cylinders. Even though the tolerance between the interior cylinder block 50 and hub 68 is kept to a minimum, there is nevertheless an unavoidable accumulation of fuel vapour in this space. To prevent such accumulation a pair of sealing vanes 66 are provided relatively close to each cylinder, on each side thereof, serving to seal the space between cylinder block 50 and hub 68 as closely as possible. Further, such minimal accumulation of fuel vapour as is unavoidable may be extracted and returned to the intake manifold by means of a vent cavity 90, one of which is provided in cylinder block 50 centrally between each pair of vanes, communicating with the space between cylinder block 50 and hub 68, and with an exteriorly mounted tube, communicating with the intake manifold (not illustrated).

Figure 11:
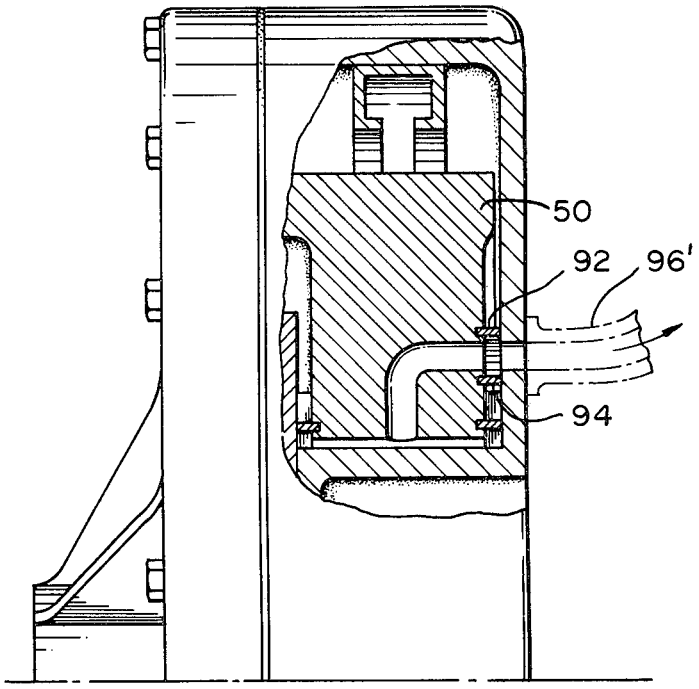
FIG. 11 is a fragmentary sectional view of an engine assembly illustrating fuel vapour suction means.

To further ensure adequate sealing, a pair of sealing rings 92 and 94 are provided on each side of the opening of suction tube 90, illustrated in broken lines in FIG. 10. Rings 92 and 94 are also illustrated in FIG. 11 in sectional view. It will thus be appreciated that suction vents 90, are under constant suction from one or more tubes 96' connected with the intake manifold.

Aside from the modifications described immediately above, the function of a four cycle engine according to the invention will be identical with the function already described in connection with the six cylinder embodiment, above. That is, there are four power strokes per revolution with the four cylinder embodiment of FIG. 10 as opposed to six power strokes per revolution with the embodiment of FIGS. 1 and 2. As has already been stated, the engine according to the invention may be usefully employed with one or more pistons.

Figure 12:
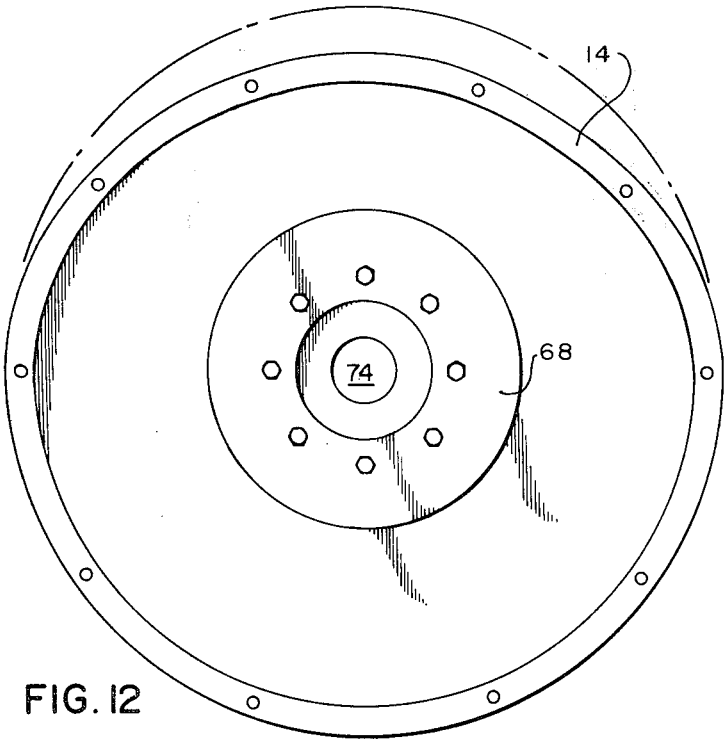
FIG. 12 is a diagrammatic section through a two-cylinder engine according to the invention.

With reference to FIG. 12 an engine casing adapted for two cycle operation is illustrated, and rather than an elliptical casing 14, a casing which is elliptical only through 180 degrees and circular through the remaining 180° is employed. As seen in FIG. 12 the bottom half of casing 14 is circular, while the top half is elliptical. Thus, in a two cycle application, there will be a longer dwell period as each cylinder passes over the exhaust port and the fuel intake port, with fuel intake being facilitated by supercharger or other means, in a manner similar to traditional two cycle engines.

The operation of the engine according to the invention will now be described.

A starting motor has not been illustrated, but it will be obvious to one skilled in the art that a starter may be conveniently associated either with the drive shaft 74, or perhaps preferably, with a gear wheel provided on flange **74*b* of cylinder block 50, with the starter drive means projecting through wall 82** of the engine casing.

Referring firstly to FIG. 1, a piston **52*b* is at full compression, and ignition is about to occur either by means of spark plug 80, or any other suitable means; piston 54*b* is part way through its power stroke; piston 56*b* is nearing the end of its exhaust stroke; piston 58*b* has completed its exhaust stroke; piston 60*b* is nearing completion of fuel intake; and piston 62*b* is approximately half way through its compression stroke. It will be seen that piston 56*b* is exhausting through exhaust port 96, while piston 60*b* is receiving fuel through intake port 76. As cylinder block 50 rotates, and with reference to FIG. 2, it will be seen that drive shaft 74 is also rotated, inasmuch as drive shaft 74 is connected with drive shaft flange 74*b*, which in turn is affixed by bolts 74*a* to cylinder block 50**.

As cylinder block 50 rotates within casing 14, it will be appreciated that oil within casing 14 will be suitably circulated within the casing, to ensure adequate lubrication of all bearing surfaces, as well as of the pistons, within the cylinders. In this connection, suitable seals **74*d* are provided at drive shaft 74**, to prevent oil leakage at these points.

With reference to FIG. 1, channels for coolants are provided in casing 14, at **14*a***, as is well known in the art.

During operation, vanes 66 and sealing rings **32 *a* and 32*b*** prevent leakage of gases from the cylinders and also prevent lubricating oil from entering into the combustion areas.

As spark plug 80 is fired, ignition of compressed fuel within cylinder **52*c* forces piston 52*b* and its associated push rod 52 outwardly against elliptical push rod roller track 64, and cylinder block 50 is thus forced to rotate in the direction of arrow 50*a* within casing 14. When cylinder 52*c* has reached the position shown in FIG. 1 as being occupied by cylinder 54*c*, piston 62*b* will have reached the position illustrated in FIG. 1 as being occupied by piston 52*b*, and will be under full compression, and ready for ignition. Simultaneously, exhausting will commence as soon as the vane in advance of each dylinder reaches exhaust port 96. Again, simultaneously, fuel commences to be drawn into each cylinder as the vane in advance thereof passes over fuel intake port 76. Thus, it can be readily appreciated that each cylinder provides one power stroke per revolution of cylinder block 50**, and in view of the relative compactness and light weight of the engine, it will be further appreciated that a very high horsepower to weight ratio is obtained.

It will be further self evident that any desired numbers of cylinders may be employed, from one upwardly, depending only on the size of each cylinder assembly and the size of the block.

It will be further appreciated, for example, with reference to FIG. 2, that engine maintenance is very simple, inasmuch as all components including the spark plugs, are readily available for servicing. While ancilliary parts such as carburetor and the like have not been illustrated, it is not believed necessary to teach one skilled in the art these well known functions. Moreover, ignition timing is greatly simplified inasmuch as a single spark plug (or a number of plugs firing substantially simultaneously) are all that is required. In other words, spark plug 80 of FIGS. 1 and 2 may represent a plurality of plugs firing in concert, and the ignition timing pre-requisites of traditional reciprocating piston engines are completely eliminated. A timing cam, for example, may be mounted conveniently on drive shaft 74 eliminating the need for any other timing mechanism such as gears, or the previously essential distributor mechanism.

It will be further appreciated that this invention eliminates most of the disadvantages of known piston engines: a crankshaft is not required; moving parts are at a mininum; friction points are far fewer than in known piston and rotary engines; power to weight ratio is at a maximum; exhaust emissions are minimal and control thereof is simplified because of low r.p.m. and high torque leverage ratios.

I claim:

1. A rotary-piston internal combustion engine comprising:

an elliptical engine casing having an inner wall and a central, cylindrical hub;

a retaining ring affixed to said hub;

a circular block centrally mounted within said casing for rotation therein and around said hub, and having at least one radial cylinder adapted to receive a piston for reciprocation therein;

at least one sealing vane on each side of said cylinder;

first spring means abutting each of said sealing vanes for urging each of said sealing vanes towards said hub to ride thereon;

second spring means within each of said sealing means for urging each of said sealing vanes towards said retaining ring to ride thereon;

a first pair of sealing rings mounted in said block adjacent to each of said vanes, each pair of sealing rings being spring urged to ride against said retainer ring and the wall of said elliptical casing respectively, said vanes and sealing rings preventing leakage of fuel vapor and combustion gases from said cylinder;

a vent in said cylinder block between said cylinders communicating at one end with the space between adjacent sealing vanes and at its other end with means connected to an intake manifold associated with said engine;

a second pair of sealing rings on each side of said port, mounted in said block and being spring urged against the wall of the elliptical casing;

a piston, disposed within said radial cylinder, having an associated push rod projecting therefrom toward said casing, said push rod terminating in a bearing adapted to be restrained against the inner wall of said casing;

an igniting means provided in said hub in radial alignment at or near the conjugate axis of said elliptical casing;

a fuel intake port and an exhaust port provided in said hub substantially opposite said igniting means, said fuel intake port and said exhaust port being approximately equidistant from the conjugate axis of said elliptical casing; and central drive shaft means within said hub on which said cylinder block is mounted, for rotation therewith.

2. A rotary-piston internal combustion engine according to claim 1 further including:

a bearing track affixed to the inner wall of of said elliptical casing; and wherein said push rod bearings comprise at least one roller bearing which is restrained in said bearing track for rotary travel therein.

3. A rotary-piston internal combustion engine according to claim 1, further including:

third spring means encircling siad push rod for urging said push rod bearing away from said cylinder block wherein said push rod bearings are in constant engagement with the interior elliptical wall of said engine casing.

4. A rotary-piston internal combustion engine according to claim 1, said cylinder block having a plurality of equally radially spaced cylinders.

5. A rotary-piston internal combustion engine according to claim 1, wherein said igniting means includes dieseling.

6. A rotary-piston internal combustion engine according to claim 1, wherein said igniting means comprises at least one spark plug.

* * * * *